United States Patent [19]

Fulton

[11] Patent Number: 4,629,246

[45] Date of Patent: Dec. 16, 1986

[54] WHEELCHAIR SEAT

[76] Inventor: William Fulton, 154 Warren Dr., R.D. #2, Dallas, Pa. 18612

[21] Appl. No.: 792,143

[22] Filed: Oct. 28, 1985

[51] Int. Cl.[4] ..... A47C 4/00

[52] U.S. Cl. ..... 297/44; 297/440; 297/DIG. 4

[58] Field of Search ..... 297/6, 42, 43, 44, DIG. 4, 297/440, 281; 248/339, 327, 215

[56] References Cited

U.S. PATENT DOCUMENTS

| | | | |
|---|---|---|---|
| 1,294,916 | 2/1919 | Knight | 248/215 |
| 1,394,224 | 10/1921 | Scott | 297/6 |
| 3,076,678 | 2/1963 | Griffin | 297/339 |
| 3,656,809 | 4/1972 | Ronning | 297/338 |
| 4,354,791 | 10/1982 | Antonellis | 280/289 WC |
| 4,380,343 | 4/1983 | Lovell et al. | 280/242 WC |
| 4,493,488 | 1/1985 | Panaia et al. | 297/42 |
| 4,514,867 | 5/1985 | Jensen | 4/480 |

*Primary Examiner*—James T. McCall

*Attorney, Agent, or Firm*—Burns, Doane, Swecker & Mathis

[57] ABSTRACT

A collapsible wheelchair comprises a pair of interconnected side portions and a seat mounted on the side portions. The seat comprises a rigid base plate which is padded. A plurality of hooks are mounted on the rigid base plate for removably supporting the base plate on the side portions of the wheelchair by loosely hanging the hooks thereon. The hooks are vertically adjustable such that the elevation of the seat may be varied. The seat is removable whenever the wheelchair is collapsed by simply lifting the hooks from the side portions of the wheelchair.

8 Claims, 5 Drawing Figures

WHEELCHAIR SEAT

BACKGROUND AND OBJECTS OF THE INVENTION

The present invention relates to wheelchairs and, in particular, to seats for wheelchairs.

Wheelchairs are typically constructed so as to be collapsible whereby opposite wheeled sides of the chair approach each other. In order to accommodate such collapsing action, the seat which supports the occupant is formed of a flexible material and is anchored at its ends to the sides of the chair. When the chair is collapsed, the seat sags and folds-up at its center to enable the collapsed chair to assume a relatively compact configuration.

Although the flexible seat affords an efficient collapsing of the chair, it does not provide ideal comfort for the occupant. That is, due to its flexibility, the seat tends to pinch the buttocks of the occupant. Consequently, many occupants tend to place a cushion on the seat for comfort. However, as the cushion bends under the weight of the occupant, to conform to the generally curvalinear shape of the seat, it, too, may tend to pinch the occupant's buttocks. In addition, the manufacturer generally locates the seat at an elevation which is optimum for most occupants. However, the application of a cushion raises the occupant to a level above the intended sitting level, whereupon the occupant may be unable to comfortably position his arms on the armrests and/or his feet on the footrests.

An object of the present invention is to minimize or obviate problems of the types discussed above.

Another object is to provide a wheelchair seat which is both comfortable and enables an occupant to sit at the proper elevation.

An additional object is to provide such a seat which provides rigid support for the occupant and is of adjustable elevation.

SUMMARY OF THE INVENTION

These objects are achieved by the present invention which relates to a collapsible wheeelchair comprising a pair of interconnected wheeled side portions, and a seat mountable on the side portions. The seat comprises a rigid base plate and a quick-release supporting structure for removably supporting the base plate on the side portions such that the base plate is removable whenever the wheelchair is collapsed. The base plate is padded.

Since the base plate is formed of a rigid material, there is little risk that the padding will be flexed sufficiently under the occupant's weight to cause the occupant's buttocks to be pinched.

Further in accordance with the invention, the elevation of the base plate can be adjusted relative to the side portions of the wheelchair. Therefore, the elevation at which the occupant sits can be adjusted to maximize the comfort of the occupant.

Preferably, the quick-release supporting means comprises hanger hooks carried by the base plate which are loosely hangable on the side portions of the wheelchair. Thus, it is merely necessary to lift the seat from the wheelchair when it is desired to collapse the wheelchair.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
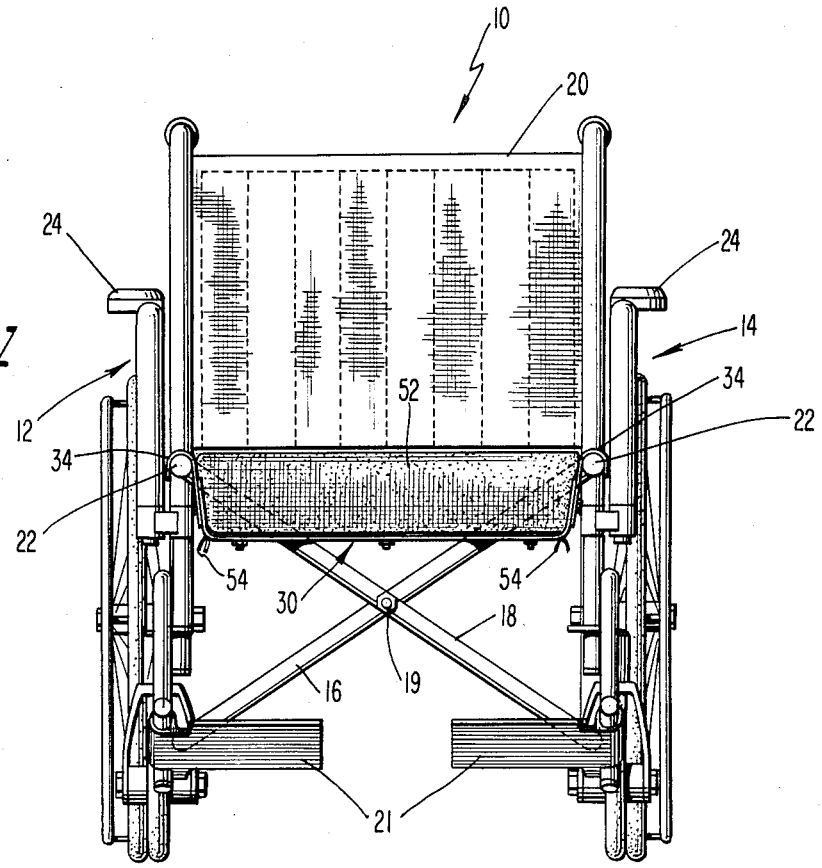
FIG. 1 is a front elevational view of a wheelchair containing a seat according to the present invention.
Figure 2:
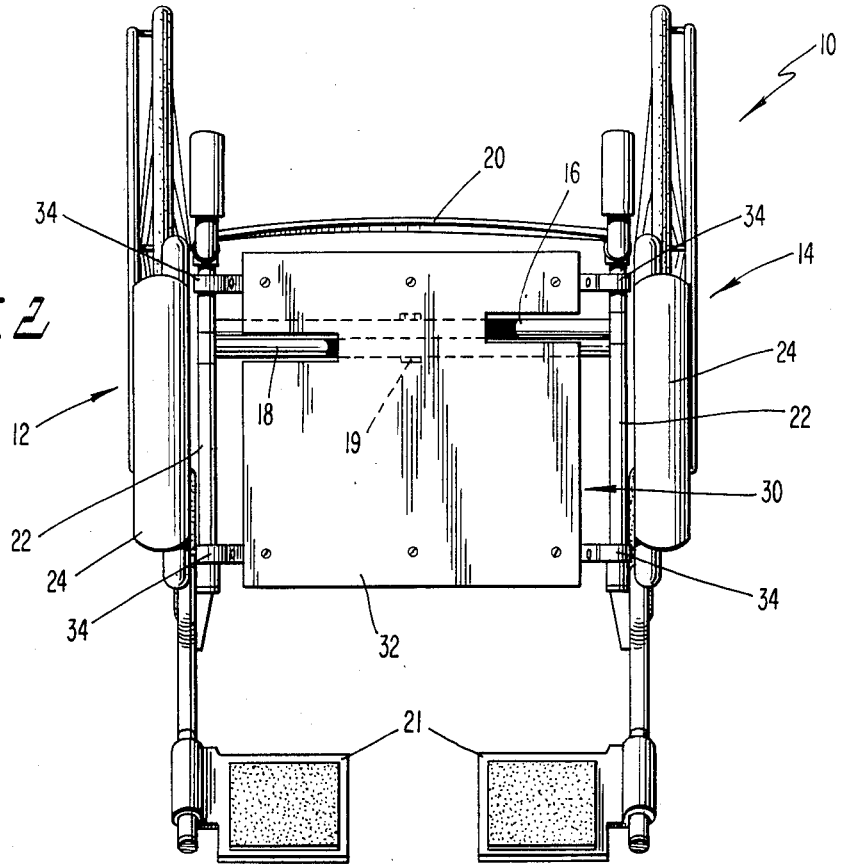
FIG. 2 is a top plan view of the wheelchair depicted in FIG. 1, with the padding for the base plate removed.
Figure 4:
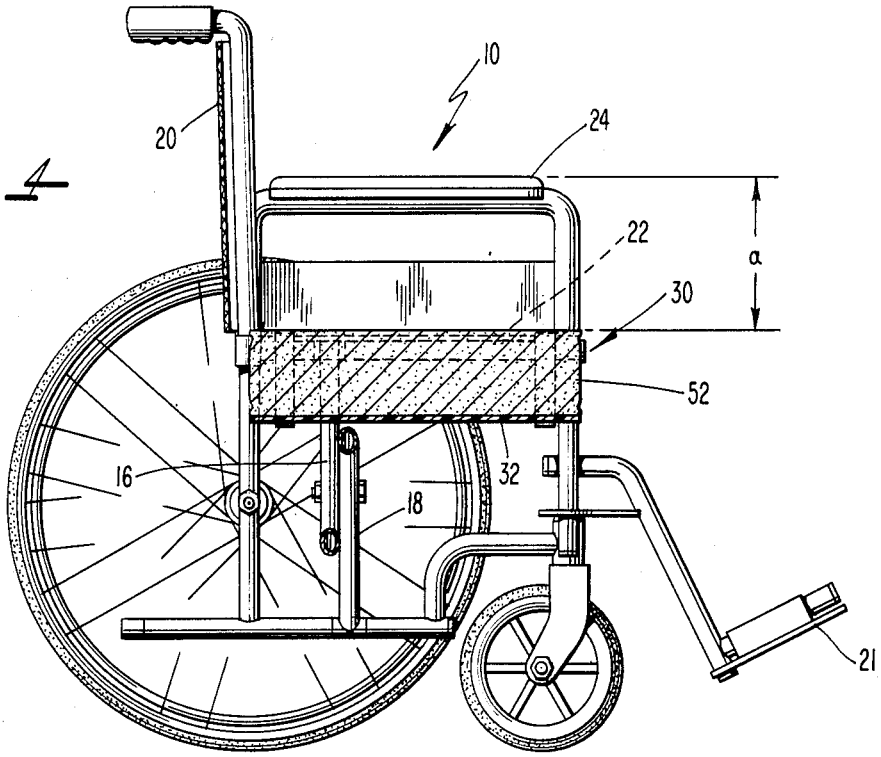
FIG. 4 is a side elevational view of the wheelchair depicted in FIG. 1.

A wheelchair 10 depicted in FIGS. 1, 2, and 4 comprises a pair of wheeled sides 12, 14 which are interconnected by a pair of struts 16, 18 and a flexible backrest 20. The struts are pivoted together at 19 to enable the chair to be collapsed in a conventional manner. Each of the sides 12, 14 includes a footrest 21, an armrest 24, and a horizontal bar 22 located below the armrest 24. It is to those bars 22 that the ends of a conventional flexible seat are usually mounted. However, in accordance with the present invention, a rigidly backed seat 30 is provided.

Figure 3:
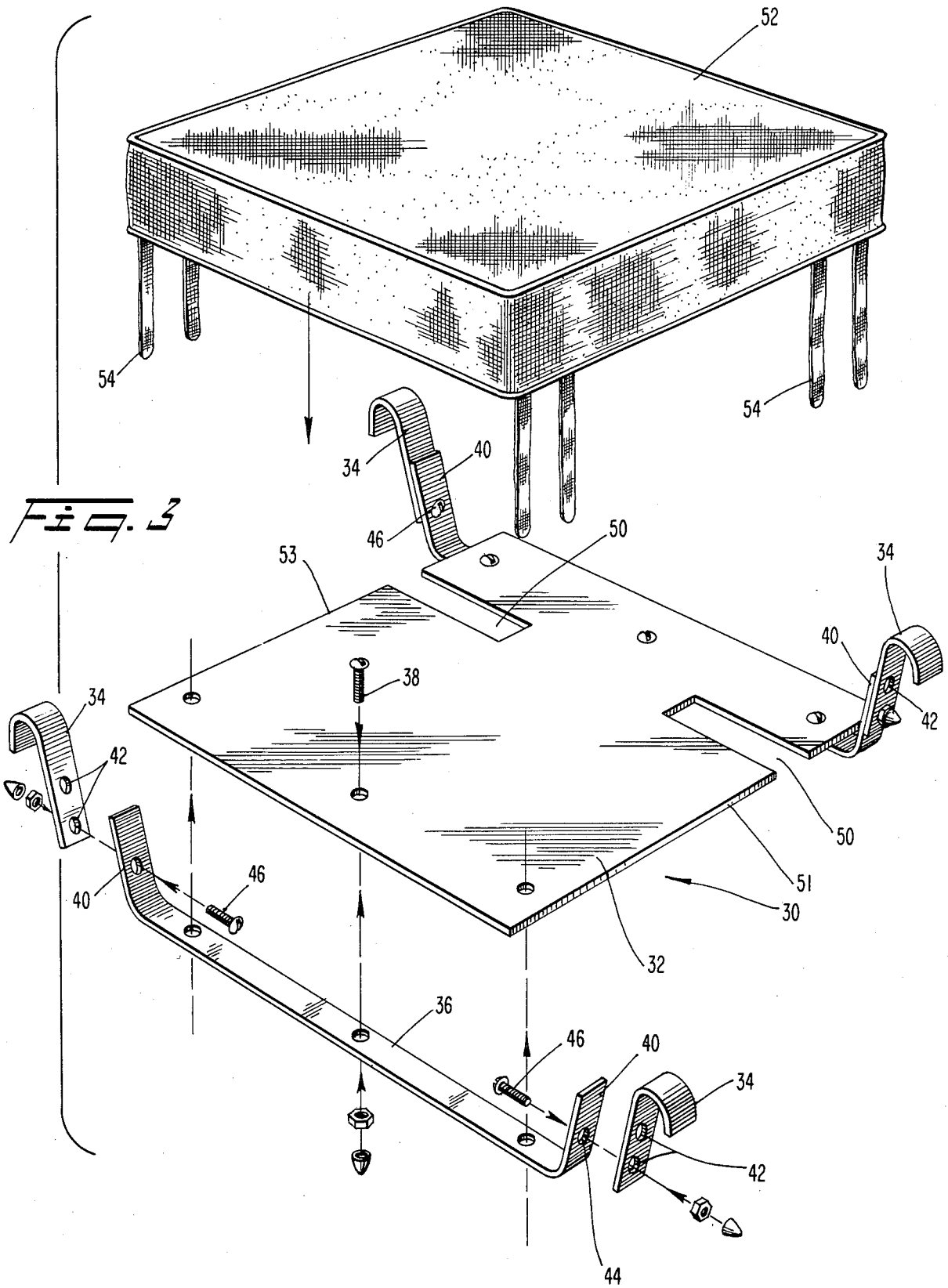
FIG. 3 is an exploded perspective view of a wheelchair seat according to the present invention.

The seat 30, depicted in detail in FIG. 3, comprises a base plate 32 formed of any suitably rigid material. A plurality of hanger hooks 34 are mounted to the plate 32. Those hooks 34 are fastened to strips 36 which are affixed to the underside of the plate 32 by bolts 38, for example. The strips 36 each extend in a side-to-side direction and include upstanding bent ends 40. It is to those ends 40 that the hooks 34 are attached, preferably in a vertically adjustable manner. Such adjustment is achieved by providing a plurality of vertically spaced holes 42 in each bracket, which holes are selectively alignable with a hole 44 in the upstanding portions 40 of the strips 36. Bolts 46 are provided for securing the brackets 34 to the strips 36. By inserting each bolt through the hole 44 in the respective strip 36 and through a selected one of the holes 42 in the hook 34, the hook 34 becomes fastened to the plate 32 and extends therefrom to a height which is dependent upon the particular hole 42 selected.

The hooks 34 are located so as to be capable of being hung upon the horizontal bars 22. Thus, the plate 32 can be quickly installed by simply being placed loosely upon those bars, and quickly removed by being lifted from the bars. Accordingly, the hooks constitute a quick-release supporting structure for the seat.

The imaginary plane defined by the base plate intersects the struts 16, 18. Accordingly, in order to accommodate the presence of the struts, slots 50 are formed in side edges 51, 53 of the base plate, in the vicinity of a rear end thereof. Those slots are mutually offset in front-to-rear direction of the wheelchair (see FIG. 2) so that when the base plate is installed, the struts 16, 18 will pass through the slots.

The plate 32 is provided with padding for the occupant's comfort. Preferably, such padding is provided by a cushion 52 placed upon the base plate. The cushion 52 can be loosely disposed upon the plate 32 or affixed thereto. Such affixing can be achieved by pairs of ties 54 which depend from the cushion and are tied around respective ones of the stripps 36.

Since the seat 30 is adjustable in height, the cushion can be located at various elevations relative to the armrests 24 and footrests 21 to accommodate the size of the occupant. Furthermore, the plate 32 provides a rigid support for the cushion to prevent the cushion from bending in a manner tending to pinch occupant's buttocks.

Figure 5:
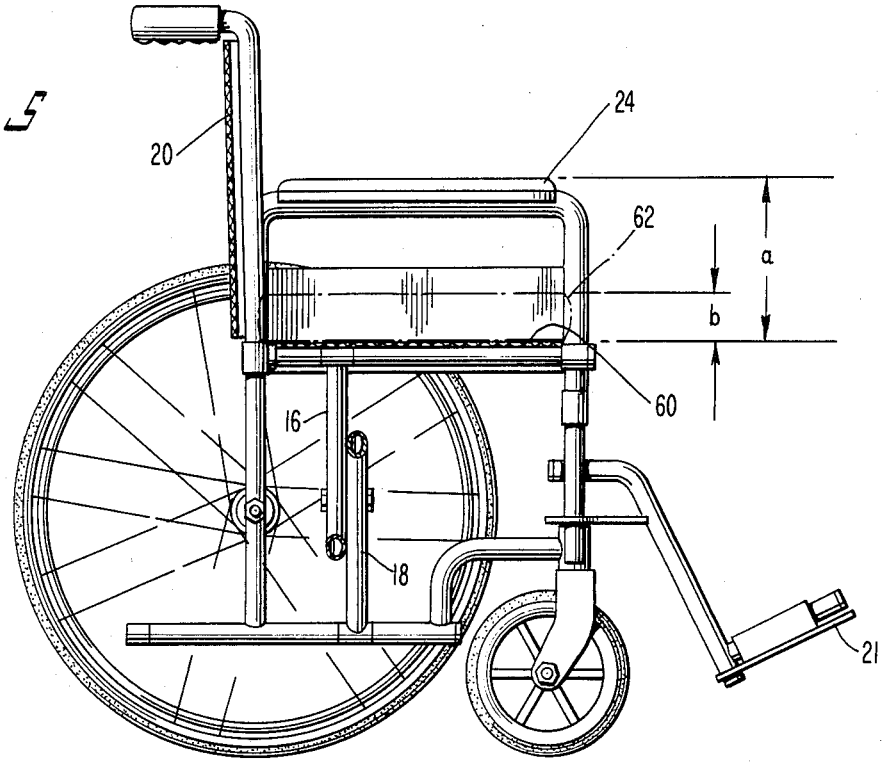
Fig. 5 PRIOR ART
FIG. 5 is a side elevational view of a conventional wheelchair.

A comparison of the seat 30 according to the present invention with a conventional flexible seat 60 (FIG. 5) demonstrates the fact that in a conventional seat 60, manufactured with the seat 60 at an optimum distance a from the armrests 24, the addition of a cushion 62 (shown in phantom lines in FIG. 5) raises the occupant to a distance x above that optimum height. However, the seat according to the present invention can be adjusted to position the cushion 52 at an optimum distance a or other desired distances as well. This advantage is achieved in addition to the rigid reinforcement provided by the rigid plate 32 which resists bending of the padding 52 and thus resists pinching of the occupant's buttocks.

Although the present invention has been described in connection with a preferred embodiment thereof, it will be appreciated by those skilled in the art that modifications, substitutions, additions, and deletions may be made without specifically departing from the spirit and scope of the invention as defined in the appended claims.

What is claimed is:

1. In a collapsible wheelchair comprising a pair of interconnected wheeled side portions, and a seat mountable on said side portions and comprising a rigid base plate, padding means for an upper surface of said rigid base plate, and quick-release supporting means for removably supporting said rigid base plate on said side portions such that said rigid base plate is removable whenever said wheelchair is collapsed, said side portions each comprising a horizontal bar, said supporting means arranged to attach said rigid base plate to said bars such that said upper surface of said rigid base plate is disposed at a level lower than said bars whereby said padding means can be disposed on said rigid base plate without raising the occupant above a comfortable sitting level.

2. In a wheelchair according to claim 1, wherein said supporting means comprises hanger hooks carried by said rigid base plate and which are hangable on said horizontal bars.

3. In a wheelchair according to claim 2, wherein said hooks are vertically adjustable on said base plate to enable the elevation of said rigid base plate to be adjusted relative to said side portions.

4. In a collapsible wheelchair comprising a pair of interconnected wheeled side portions, and a seat mountable on said side portions and comprising a rigid base plate, padding means for said rigid base plate, and quick-release supporting means for removably supporting said rigid base plate on said side portions such that said rigid base plate is removable whenever said wheelchair is collapsed, said wheelchair including pivotably interconnected struts, said rigid base plate including slots for receiving said struts.

5. In a wheelchair according to claim 4, wherein said rigid base plate includes a pair of side edges, said slots being formed in said side edges and mutually offset in a front-to-rear direction of said wheelchair for receiving said struts.

6. In a wheelchair according to claim 4 including means for adjusting the elevation of said rigid base plate relative to said side portions.

7. In a wheelchair according to claim 4, wherein said supporting means comprises hanger hooks carried by said rigid base plate and which are hangable on said side portions of said wheelchair.

8. In a wheelchair according to claim 7, wherein said hooks are vertically adjustable on said base plate to enable the elevation of said rigid base plate to be adjusted relative to said side portions.

* * * * *